US008689666B2

(12) United States Patent
Goettel et al.

(10) Patent No.: US 8,689,666 B2
(45) Date of Patent: Apr. 8, 2014

(54) DRIVE LINK WITH IMPROVED LUBRICATION FEATURE

(75) Inventors: Mike Goettel, Canby, OR (US); Scott Ferguson, Portland, OR (US)

(73) Assignee: Blount, Inc., Portland, OR (US)

( * ) Notice: Subject to any disclaimer, the term of this patent is extended or adjusted under 35 U.S.C. 154(b) by 274 days.

(21) Appl. No.: 12/940,351

(22) Filed: Nov. 5, 2010

(65) Prior Publication Data

US 2011/0100188 A1 May 5, 2011

Related U.S. Application Data

(60) Provisional application No. 61/258,519, filed on Nov. 5, 2009.

(51) Int. Cl.
*B27B 17/12* (2006.01)

(52) U.S. Cl.
USPC ..... 83/830; 83/169

(58) Field of Classification Search
USPC ..... 83/830–834, 788, 169, 381–387
See application file for complete search history.

(56) References Cited

U.S. PATENT DOCUMENTS 2,622,636 A * 12/1952 Cox ..... 83/834
3,292,670 A * 12/1966 Ratz et al. ..... 30/123.4
3,478,787 A * 11/1969 Miller ..... 30/123.4
4,434,556 A * 3/1984 Nitschmann et al. ..... 30/123.4
4,934,052 A * 6/1990 Nitschmann et al. ..... 30/123.4
6,223,640 B1 * 5/2001 Sundstrom ..... 83/830
2006/0243097 A1 11/2006 Raczykowski
2008/0011144 A1 * 1/2008 Harfst et al. ..... 83/830
2008/0034938 A1 * 2/2008 Fuchs ..... 83/830
2008/0110317 A1 5/2008 Osborne et al.

FOREIGN PATENT DOCUMENTS

JP 2000102901 A 4/2000

* cited by examiner

*Primary Examiner* — Andrea Wellington
*Assistant Examiner* — Brendan Ayer
(74) *Attorney, Agent, or Firm* — Schwabe, Williamson & Wyatt

(57) ABSTRACT

Various embodiments of the present disclosure generally provide a drive link for a saw chain including a body portion adapted to couple to adjacent side links and a tang extending from the body and sized to engage a guide bar groove. The tang may include a through hole extending from a first tang side to a second tang side and including a through hole center. In various embodiments, a material directing feature may be disposed adjacent to the through hole on at least one of the first side and second side of the tang. The material directing feature may include a recession in the tang which encourages oil and/or wood chips to pass through the through hole.

16 Claims, 3 Drawing Sheets

DRIVE LINK WITH IMPROVED LUBRICATION FEATURE

CROSS REFERENCE TO RELATED APPLICATIONS

The present application claims priority to U.S. Provisional Application No. 61/258,519, which was filed on 5 Nov. 2009, titled "Drive Link with Improved Lubrication Feature." The entire disclosure is hereby incorporated by reference.

TECHNICAL FIELD

Embodiments herein relate to the field of saw chains used for chainsaws, and more specifically to drive links having improved lubrication features to facilitate chain and bar lubrication and improved operation.

BACKGROUND

Chain saws, harvesters and the like are typically used in conjunction with saw chains to cut wood and other material. Saw chains, which are a collection of components that typically include cutter links, side links, center links, and/or drive links, are driven around a guide bar by the chain saw or harvester. Due to the speeds at which the saw chain is driven, the material being cut and the forces encountered, the chain drive links and guide bar grooves need to be well lubricated. It has been a constant challenge to not only properly lubricate on both sides of the chain, but also along the entire length of the guide bar.

Of the many features that have been implemented over the years to try and improve lubrication, locating a through hole in the body of the drive link has proven to provide the best lubrication solution. Invented by Blount Inc, and referred to as LUBRIWELL™, the hole is designed to carry lubricating oil along a guide bar groove, thus reducing sliding friction and reducing bar and chain wear. Secondarily, the through hole may carry wood chips that are oil soaked, thus promoting a wicking action to facilitate spreading lubrication oil along the bar groove and to other components of the cutting system. However, a draw back of the through hole is that with some designs and in some cutting conditions, the hole may become clogged, for example, with wood chips and/or other debris. The chips can be so compacted that friction is created between the chips and the bar groove, thus generating resistance that can exceed the available horsepower of the saw and thus hamper cutting and performance.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1A:
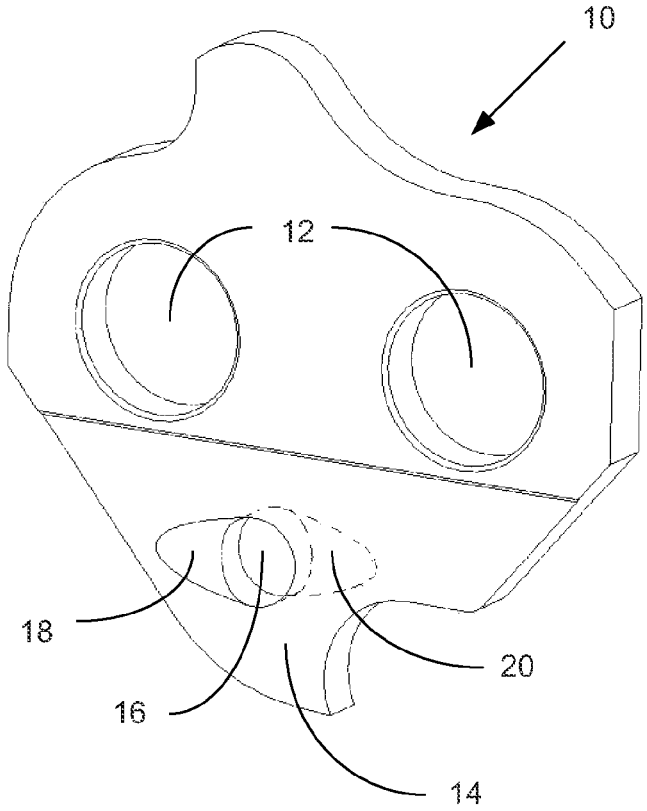
FIGS. 1A and 1B illustrate different views of a drive link in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

In various embodiments of the present invention, an improved saw chain drive link is provided that can improve lubrication in a saw chain in several ways, including, but not limited to: (1) increased oil distribution within the cutting system without providing for a larger oil hole; (2) enhance passing wood chips through the hole, thus further improving lubrication; (3) promote self clearing of wood chips, which resists clogging of the oil hole and thus inhibits excess power consumption and reduction of cutting performance; (4) increase the oil carrying capacity of the hole; (5) promote increased lubrication to both sides of the chain chassis; and (6) improve the ability to pick up oil from the saw's oiler.

Various embodiments of the present disclosure generally provide a drive link for a saw chain including a body portion adapted to couple to adjacent side links and a tang extending from the body and sized to engage a guide bar groove. The tang may include a through hole extending from a first tang side to a second tang side and including a through hole center. In various embodiments, a material directing feature may be disposed adjacent to the through hole on at least one of the first side and second side of the tang. The material directing feature may include a recession in the tang which encourages oil and/or wood chips to pass through the through hole.

In various embodiments, the first side of the tang may generally be the side facing the motor and/or oiler of a chain saw when in use on a chain saw. The second side of the tang may be the outward facing side. In embodiments with a material directing feature on the first side of the tang, the material directing feature may encourage oil and/or wood chips to pass through the through hole, thereby distributing oil along the guide bar groove as the saw chain travels around the guide bar groove. In embodiments with a material directing feature on the second side of the tang, the material directing feature may encourage oil and/or wood chips to exit the through hole, thereby facilitating the distribution of oil and preventing wood chips from becoming clogged in the through hole.

In various embodiments, the recession of the material directing feature may have a depth, a length, and a width. In some embodiments, the recession of the material directing feature may have a depth that is generally tapered as it moves away from the through hole center, such that a deepest part of the recession is adjacent to the through hole. For example, the material directing feature may gradually angle or slope toward the outer planar surface of the tang body at the end of the material directing feature opposite the through hole. In other embodiments, the material directing feature may be stepped or otherwise configured to provide a recession in the body of the tang immediately to one side of the through hole.

Similarly, in some embodiments, the recession of the material directing feature may have a width that is generally tapered as it moves away from the through hole center, such that a widest part of the recession is adjacent to the through hole. However, in other embodiments, the width of the recession may generally taper as it moves closer to the through hole, such that it becomes more narrow as it approaches the through hole. For example, the recession of the material directing feature may have an inner width at an end adjacent to the through hole and an outer width at an end away from the through hole, where the outer width is greater than the inner width. In yet other embodiments, the recession of the material directing feature may maintain a relatively constant width along the length of the recession.

In various embodiments, the depth, length and width of the material directing feature may be chosen to optimize the oil carrying capacity and chip clearing without significantly weakening the drive link. For example, the depth of the recession in the material directing feature at the deepest part may be between about 10% and about 50% of the drive link thickness. Similarly, the length of the recession at the recession's longest part may be between about 25% and about 100% of the through hole diameter. Further, the width of the recession at its widest part may be between about 5% and about 100% of the through hole diameter.

In various embodiments, the material directing feature may be generally disposed in any direction with respect to the through hole on the first side and/or second side of the tang. For example, the material directing feature may be disposed in a direction with respect to the through hole such that it will be generally parallel to a path of travel of the drive link, i.e. parallel to the guide bar groove.

In some embodiments, both the first side and second side of the tang may include a material directing feature. Including a material directing feature on both sides of the tang may encourage both entry of oil and wood chips on one side of the through hole and exit of oil and wood chips on the other side of the through hole. In embodiments with a material directing feature on both sides of the through hole, the material directing feature on the first side and the material directing feature on the second side of the tang may be oriented in any configuration relative to each other. For example, the material directing feature on the first side of the tang may be oriented opposite the material directing feature on the second side of the tang, i.e., across the diameter of the through hole.

In various embodiments, there may be multiple material directing features disposed along the first side and/or second side of the tang. The multiple material directing features may be disposed in any orientation with respect to each other, such as parallel, perpendicular, and/or a star pattern around the through hole.

In various embodiments, a plurality of drive links may be coupled together by side links and/or cutter links to form a saw chain. One or more of the drive links may include at least one material directing feature. In some embodiments, all of the drive links on the saw chain may include at least one material directing feature. In other embodiments, some drive links may include a material directing feature while other drive links may not. For example, every other drive link on the saw chain may include a material directing feature.

Figure 1B:
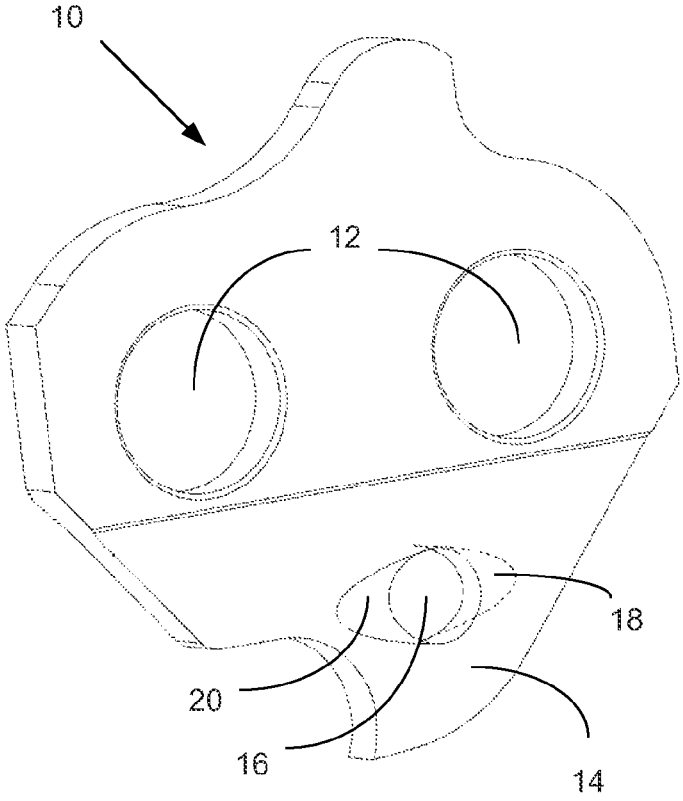

FIGS. 1A and 1B illustrate first and second sides of a drive link adapted for use in a saw chain in accordance with various embodiments. The drive link 10 may include rivet holes 12 that adapt the drive link for coupling to other saw chain components such as a cutter link, center link, and/or side links (not shown). Tang 14 may protrude generally downward and be sized to engage a groove of a guide bar and the gullets of drive and nose sprockets. Through hole 16 may be disposed in the body of the tang 14.

The first side of the tang 14 may have a material directing feature 18 that comprises a recession in the body of the tang 14 immediately preceding the through hole 16. Material directing feature 18 may, among other things, increase the carrying capacity of the through hole 16, facilitate movement of oil from the first side to the second side of the drive link 10, and help with chip flow and resist chip clogging or packing in the through hole 16. The second side of the tang 14 may include a material directing feature 20 that includes a recession in the body of the tang 14 immediately following the through hole 16.

As illustrated in FIGS. 1A-B the recessions of the material directing features 18 and 20 may have a depth that is generally tapered as the feature moves away from through hole 16, such that the deepest part of the recession is adjacent to through hole 16. The recession may gradually angle or slope toward the outer planar surface of the tang body at the end of the material directing feature opposite the through hole.

Figure 2:
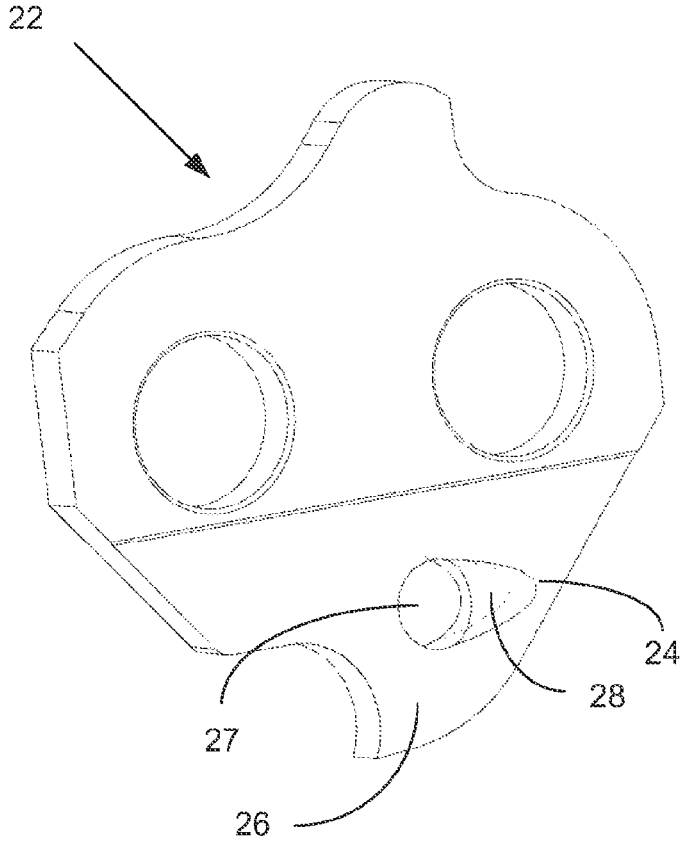
FIG. 2 illustrates a perspective view of a drive link in accordance with various embodiments.

In the embodiment illustrated in FIGS. 1A-B, the material directing feature 18 on the first side of tang 14 is oriented on the opposite side of the through hole 16 from the material directing feature 20 on the second side of tang 14. Alternatively, FIG. 2 illustrates a drive link 22 with a material directing feature 24 on the first side of tang 26 oriented on the same side of through hole 27 as a material directing feature 28 on the second side of tang 26.

Figure 3:
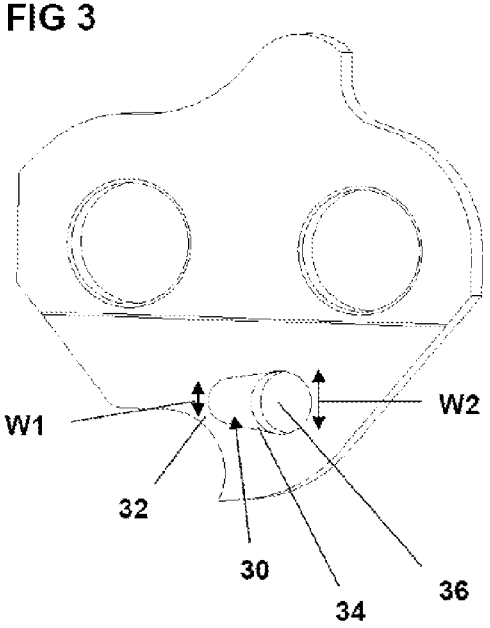
FIG. 3 illustrates a perspective view of a drive link in accordance with various embodiments.
Figure 4:
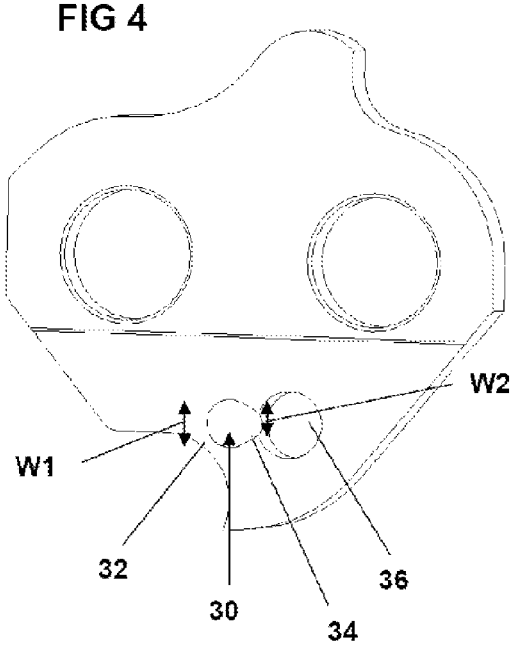
FIG. 4 illustrates a perspective view of a drive link in accordance with various embodiments.

FIGS. 3 and 4 illustrate various other examples of drive links in accordance with various embodiments where material directing feature 30 may have a feature outer end 32 having a width W1 and a an inner end 34 closest to the through hole 36 having a width W2. As illustrated in FIG. 3, W1 may be less than W2. As illustrated in FIG. 4, W1 may be greater than W2. Further, in some embodiments, W2 may be the same as or less than the diameter of the through hole and/or W1.

Figure 5:
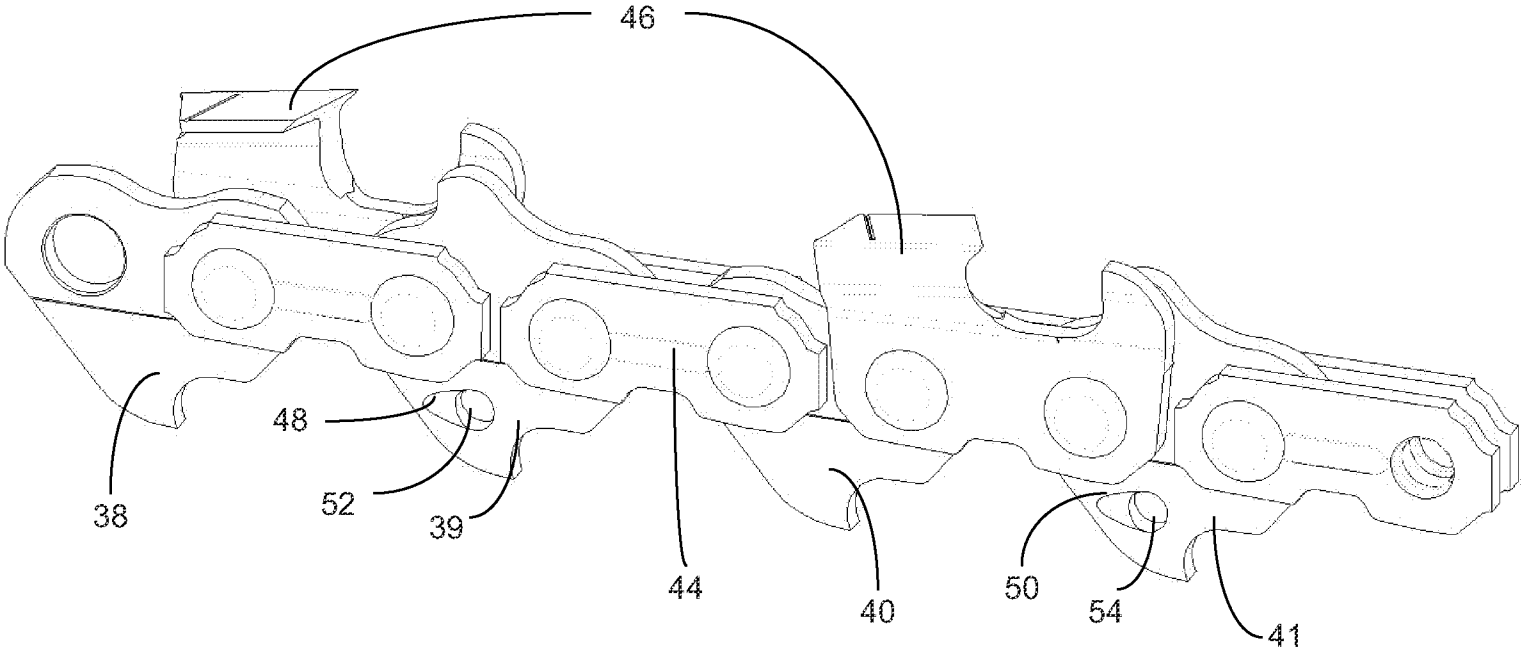
FIG. 5 illustrates a perspective view of a portion of a saw chain in accordance with various embodiments.

FIG. 5 illustrates a saw chain including drive links 38, 39, 40 and 41 coupled together by side links 44 and cutter links 46, in accordance with various embodiments. Drive links 39 and 41 may include material directing features 48 and 50 adjacent to through holes 52 and 54, respectively. In the embodiment shown in FIG. 5, every other drive link (i.e., alternating) on the saw chain includes a material directing feature. In other embodiments, any combination of some or all of the drive links on the saw chain may include one or more material directing features.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A drive link for a saw chain comprising:

a body portion adapted to couple to adjacent side links;

a tang extending from the body and sized to engage a guide bar groove, the tang including first and second opposing surfaces and a through hole extending through the tang from the first surface to the second surface of the tang and having a through hole center;

a first material directing feature disposed adjacent to the through hole on the first surface of the tang, the material directing feature including a first recession in the first surface of the tang that is oriented generally parallel to a path of travel of the drive link, wherein the first material directing feature is disposed on a first side of the through hole on the first surface, and wherein the drive link does not include a material directing feature on a second side of the through hole on the first surface, wherein the second side is opposite the first side across the through hole; and a second material directing feature disposed adjacent to the through hole on the second surface of the tang, the second material directing feature including a second recession in the second surface of the tang, wherein the first and second material directing features are configured to cooperate to facilitate movement of oil or wood chips from the first surface to the second surface of the tang via the through hole, wherein the second material directing feature is disposed on the second side of the through hole on the second surface, and wherein the drive link does not include a material directing feature on the first side of the through hole on the second surface.

2. The drive link of claim 1 wherein at least one of the first recession or second recession has a depth that decreases as it moves away from the through hole center.

3. The drive link of claim 1 wherein at least one of the first recession or second recession has a width that decreases as it moves away from the through hole center.

4. The drive link of claim 3 wherein a widest part of at least one of the first or second recession has a width that is substantially equal to a diameter of the through hole.

5. The drive link of claim 1 wherein at least one of the first or second recession has an inner width at an end adjacent to the through hole and an outer width at an end away from the through hole, the outer width being greater than the inner width.

6. The drive link of claim 1 wherein respective surfaces of the first and second material directing features are aligned with one another to facilitate movement of oil or woodchips from the first material directing feature to the second material directing feature.

7. A saw chain comprising:

a plurality of side links and cutter links; and a plurality of drive links coupled together by one or more of the side links or cutter links, one or more of the drive links including:

a body portion adapted to couple to adjacent side links;

a tang extending from the body and sized to engage a guide bar groove, the tang including first and second opposing surfaces and a through hole extending through the tang from the first surface to the second surface of the tang and having a through hole center;

a first material directing feature disposed adjacent to the through hole on the first surface of the tang, the first material directing feature including a first recession in the first surface of the tang that is oriented generally parallel to a path of travel of the drive link and disposed in a first direction from the through hole, wherein the one or more drive links do not include a recession adjacent the through hole on the first surface disposed in a second direction from the through hole, opposite the first direction; and a second material directing feature disposed adjacent to the through hole on the second surface of the tang, the second material directing feature including a second recession in the second surface of the tang that is oriented generally parallel to the path of travel of the drive link and in the second direction from the through hole, wherein the one or more drive links do not include a recession adjacent the through hole on the second surface and disposed in the first direction from the through hole, wherein the first and second material directing features are configured to facilitate movement of oil or wood chips between the first surface and the second surface of the tang via the through hole.

8. The saw chain of claim 7 wherein at least one of the first recession or second recession has a depth that decreases as it moves away from the through hole center.

9. The saw chain of claim 7 wherein at least one of the first recession or second recession has a width that decreases as it moves away from the through hole center.

10. The saw chain of claim 9 wherein a widest part of the at least one of the first or second recession has a width that is substantially equal to a diameter of the through hole.

11. The saw chain of claim 7 wherein at least one of the first or second recession has an inner width at an end adjacent to the through hole and an outer width at an end away from the through hole, the outer width being greater than the inner width.

12. A method of directing oil and debris in a chain saw comprising:

providing a saw chain adapted to engage a guide bar of a chain saw and having:

one or more drive links, the drive links including:

a body portion adapted to couple to adjacent side links; and a tang extending from the body and sized to engage a guide bar groove, the tang including first and second opposing surfaces and a through hole extending from the first surface to the second surface of the tang and having a through hole center;

a first material directing feature disposed adjacent to the through hole on the first surface of the tang, the first material directing feature including a recession in the first surface of the tang that is oriented generally parallel to a path of travel of the drive link and disposed in a first direction from the through hole, wherein the one or more drive links do not include a recession adjacent the through hole on the first surface disposed in a second direction from the through hole, opposite the first direction; and a second material directing feature disposed adjacent to the through hole on the second surface of the tang, the second material directing feature including a recession in the second surface of the tang that is oriented generally parallel to the path of travel of the drive link in the second direction from the through hole, wherein the one or more drive links do not include a recession adjacent the through hole on the second surface and disposed in the first direction from the through hole, wherein respective surfaces of the first and second material directing features are aligned with one another across the through hole to facilitate movement of oil or wood chips from the first surface to the second surface of the tang via the through hole; and moving oil or wood chips, during operation of the chain saw, from a first side of the guide bar that faces an oiler to a second side of the guide bar by way of the first and second material directing features.

13. The method of claim 12 wherein the recession of the first material directing feature has a depth that decreases as it moves away from the through hole center.

14. The method of claim 12 wherein the recessions of the first and second material directing features have a width that decreases as it moves away from the through hole center.

15. The method of claim 14 wherein a widest part of the recession of the first material directing feature has a width that is substantially equal to a diameter of the through hole.

16. The method of claim 12 wherein the recessions of the first and second material directing features have an inner width at an end adjacent to the through hole and an outer width at an end away from the through hole, the outer width being greater than the inner width.

* * * * *